US008783154B1

(12) United States Patent
Windham et al.

(10) Patent No.: US 8,783,154 B1
(45) Date of Patent: Jul. 22, 2014

(54) SEEBECK ACTIVE COOLING DEVICE FOR CALIBER WEAPONS

(71) Applicants: James J. Windham, Bettendorf, IA (US); Ryan P. Martin, Bettendorf, IA (US); Jessica M. Hale, Davenport, IA (US)

(72) Inventors: James J. Windham, Bettendorf, IA (US); Ryan P. Martin, Bettendorf, IA (US); Jessica M. Hale, Davenport, IA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/687,075

(22) Filed: Nov. 28, 2012

(51) Int. Cl.
*F41A 13/00* (2006.01)
*F41A 13/12* (2006.01)
*F41A 13/10* (2006.01)

(52) U.S. Cl.
CPC ..... *F41A 13/12* (2013.01); *F41A 13/10* (2013.01)
USPC ..... 89/14.1

(58) Field of Classification Search
CPC ..... F41A 13/12; F41A 13/10
USPC ..... 89/14.1
See application file for complete search history.

(56) References Cited

U.S. PATENT DOCUMENTS

| | | | | | |
|---|---|---|---|---|---|
| 1,328,230 | A * | 1/1920 | Johnston | 89/12 |
| 1,371,351 | A * | 3/1921 | Cassetta et al. | 89/151 |
| 1,413,903 | A * | 4/1922 | Czegka | 89/14.1 |
| 1,527,585 | A * | 2/1925 | Laurens et al. | 89/14.1 |
| 1,543,262 | A * | 6/1925 | Methlin | 89/14.1 |
| 1,551,617 | A * | 9/1925 | Pohlmann | 89/14.1 |
| 2,042,449 | A * | 6/1936 | Baumann | 89/14.1 |
| 4,463,653 | A * | 8/1984 | Pusch et al. | 89/14.1 |
| 4,982,648 | A * | 1/1991 | Bol et al. | 89/14.1 |
| 5,092,157 | A * | 3/1992 | Achter et al. | 73/863.12 |
| 5,092,220 | A * | 3/1992 | Rounbehler | 89/1.1 |
| 5,098,451 | A * | 3/1992 | Rounbehler et al. | 96/101 |
| 5,117,734 | A * | 6/1992 | Rhoads | 89/14.1 |
| 5,202,530 | A * | 4/1993 | Stephens | 89/7 |
| 5,726,375 | A * | 3/1998 | Adams et al. | 89/14.1 |
| 6,461,752 | B1 * | 10/2002 | Leung | 429/421 |
| 6,679,156 | B1 * | 1/2004 | Danou | 89/14.1 |
| 6,705,195 | B1 * | 3/2004 | Thornton | 89/14.1 |
| 7,563,097 | B2 * | 7/2009 | Lavigna et al. | 434/16 |
| 7,594,463 | B2 * | 9/2009 | Skinner | 89/1.2 |
| 2004/0094025 | A1 * | 5/2004 | Meissner et al. | 89/14.1 |
| 2007/0039224 | A1 * | 2/2007 | Skinner | 42/106 |

OTHER PUBLICATIONS

"The Solid State Conversion of Heat to Electricity," Hi-Z Technology, Inc. Jul. 11, 2011, available at: http://www.hi-z.com/index.php.
Sunonwealth Electric Machine Industry Co., Ltd. Jul. 11, 2011, available at: http://www.sunon.com.
Fairbanks, John W. "Thermoelectric Developments for Vehicular Applications," Diesel Engine-Efficiency and Emissions Research (DEER) Conference, Detroit, MI. (Aug. 24, 2006). Available at: http://www1.eere.energy.gov/vehiclesandfuels/pdfs/deer_2006/session6/2006_deer_fairbanks.pdf.

* cited by examiner

*Primary Examiner* — Michael David
(74) *Attorney, Agent, or Firm* — Henry S. Goldfine

(57) ABSTRACT

A Seebeck active cooling device for use in conjunction with a weapon to cool the barrel, in order to reduce its weight, to remove the need for a second barrel, and to prolong its useful life. In particular, the cooling device employs a plurality of thermoelectric devices that convert the energy from the heat produced by the hot barrel during the operation to an electric current. The electric current powers a series of electric fans, which in turn, cool the barrel.

10 Claims, 7 Drawing Sheets

SEEBECK ACTIVE COOLING DEVICE FOR CALIBER WEAPONS

GOVERNMENTAL INTEREST

The invention described herein may be manufactured and used by, or for the Government of the United States for governmental purposes without the payment of any royalties thereon.

FIELD OF THE INVENTION

The present invention relates in general to the field of munitions. More specifically, this invention relates to an improved means of cooling the barrel of a weapon, which offers the potential to reduce its weight, to remove the need for a second barrel, and to improve its barrel life. In particular, the present invention uses a thermoelectric device to convert the energy from the heat produced by a hot barrel during operation, to power a fan that cools the barrel.

BACKGROUND OF THE INVENTION

The weight reduction of small arms weapons is a significant concern for a soldier. A significant portion of the weight of individual and crew served weapons is in the barrel of the weapon. Much of the additional weight is necessary, not only to withstand the pressure of firing the cartridge, but also as a heat sink to absorb the thermal energy of firing the weapon.

In fact, machine guns typically have a removable, secondary barrel for the purpose of replacing the barrel after firing for a short time, in order to allow the primary barrel to cool. This additional barrel adds weight and complexity to the weapon.

What is therefore needed is a device for cooling the weapon barrel with significant weight reduction. In other terms, it would be desirable to solve the cooling problem and to remove the redundant weight associated with the need for a second barrel. Furthermore, since the barrel life is primarily a function of the barrel temperature, barrels fired at lower temperatures last significantly longer. As a result, it would be desirable to extend the life of the barrel by reducing its operation temperature. Prior to the advent of the present invention, the need for such a cooling means has heretofore remained unsatisfied.

SUMMARY OF THE INVENTION

The present invention satisfies this need, and describes a barrel cooling device and method (collectively referred to as "the present device," "the present method", or "the present system"). The present device captures the energy from the heat produced by a hot barrel during operation, and converts the captured energy into electric power that energizes one or more thermoelectric fans to cool the barrel.

Barrel cooling typically occurs through natural convection of the airflow around the barrel. Generally, forced air convection can result in significant improvement of cooling compared to natural convection. The barrel cooling device of the present device uses the heat of the barrel during firing as a means to cool the barrel.

The barrel cooling device uses a thermoelectric generator that is mounted to the barrel, which produces electricity as the barrel heats up from firing. The generated electrical current drives a series of electric fans to cool the barrel.

The thermoelectric effect is the direct conversion of temperature differences to electric voltage and vice-versa. A thermoelectric device creates a voltage when there is a difference in temperature on opposite sides of semiconductors to produce electrical energy.

To this end, when the thermoelectric device is placed on a hot barrel it uses the recaptured heat energy to power a series of thermoelectric fans. This effect accelerates the air cooling of the barrel. A cooler barrel increases the lifespan of the barrel, and allows the weight of the barrel to be reduced because less material is required for a heat sink.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
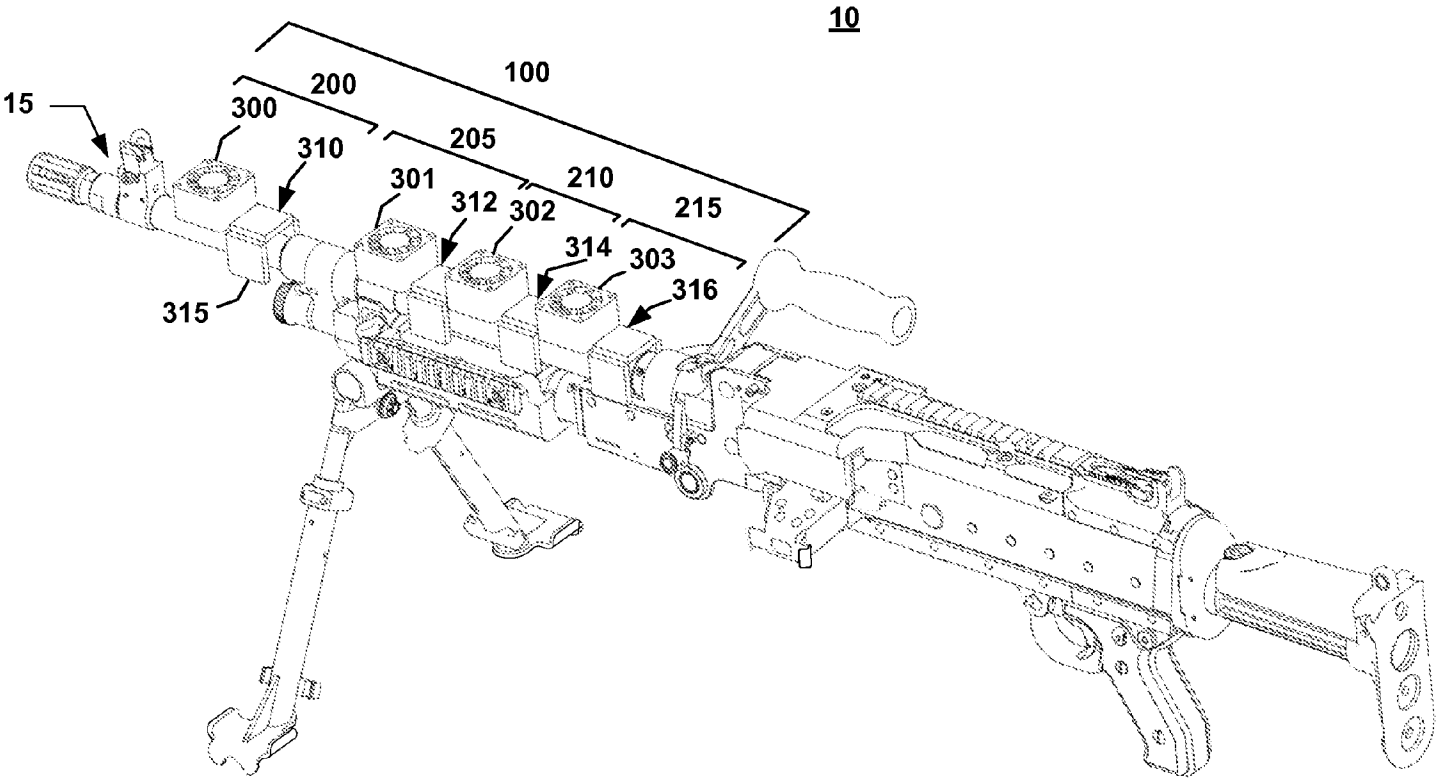
FIG. 1 is a perspective view of an exemplary machine gun provided with a cooling device that is mounted onto the machine gun barrel according to the present invention.

FIG. 1 illustrates an exemplary machine gun 10 that is provided with a thermoelectric cooling device 100. In this exemplary preferred embodiment of the present invention, the thermoelectric cooling device 100 is mounted onto the machine gun barrel 15. The cooling device 100 includes a plurality of thermoelectric fans 200, 205, 210, 215.

While four thermoelectric fans 200, 205, 210, 215 are shown in FIG. 1, it should be clear that a different number of thermoelectric fans and corresponding devices could be used. In addition, while the present invention will be described in connection with the machine gun 10, it should be clearly understood that the present invention may be used with other weapons and weapon systems, including but not limited to rifles.

In one embodiment, the thermoelectric fans include three thermoelectric fans 205, 210, 215 that are generally equally spaced between the gas block and the chamber, and a fourth thermoelectric fan 200 that is located between the gas block and the front sight of the machine gun.

As used herein, thermoelectric fans are electric fans that are powered by the thermoelectric effect. The thermoelectric effect is also referred to as the Seebeck effect, and is used to generate electricity. Generally, the thermoelectric effect encompasses three separately identified effects: the Seebeck effect, the Peltier effect, and the Thomson effect.

In general, a thermoelectric device includes one or a series of p-type semiconductor elements and one or a series of n-type semiconductor elements that are electrically connected. When the two dissimilar elements are subjected to different temperatures, the Seebeck effect causes a voltage to be generated across the junctions between the p-type and n-type semiconductor elements.

Figure 2:
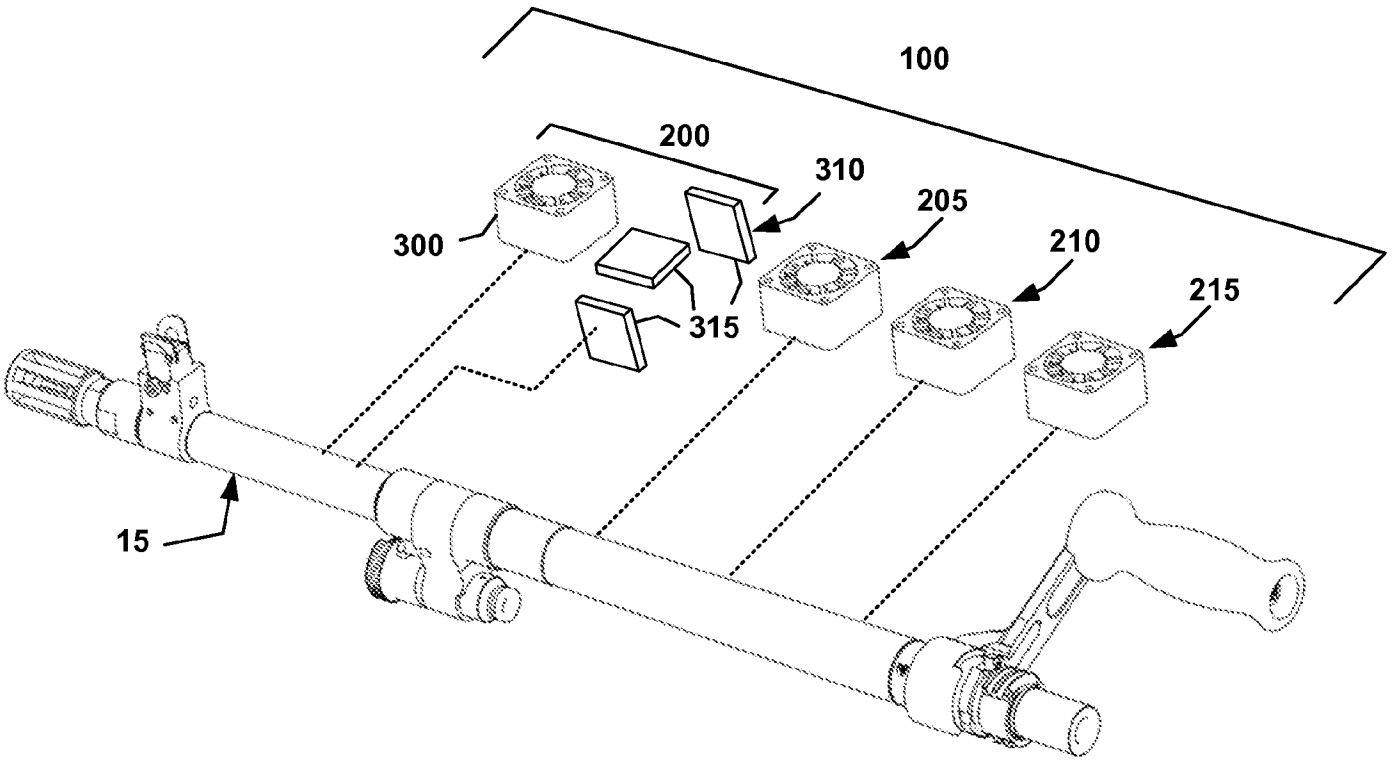
FIG. 2 is an exploded view of the machine gun barrel of FIG. 1, illustrating the cooling device of FIG. 1, as including a plurality of thermoelectric fans that are automatically powered by the heat emanating from the barrel, to cool the barrel according to the present invention.
Figure 3:
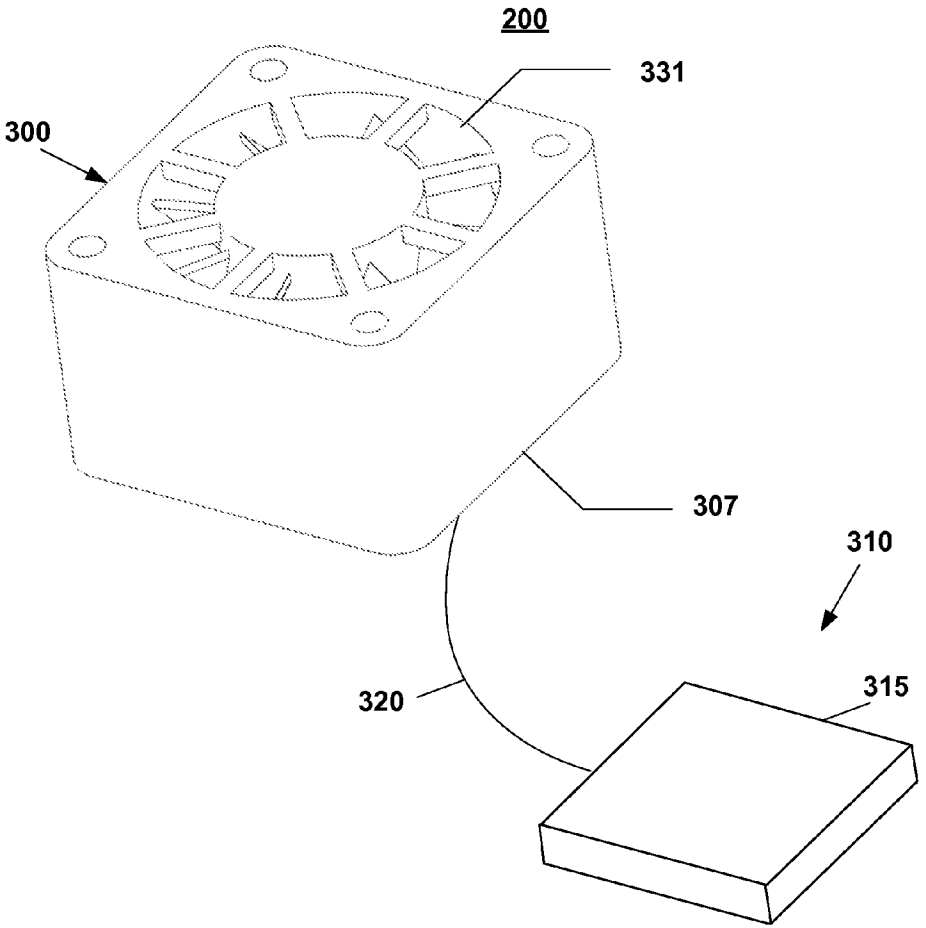
FIG. 3 is an enlarged schematic view of a thermoelectric fan according to a preferred embodiment of the present invention.

With further reference to FIGS. 2 and 3, the thermoelectric cooling device 100 includes the thermoelectric fans 200, 205, 210, 215. In FIG. 3, one thermoelectric fan 200 is shown in more detail for clarity of illustration, with the understanding that the other thermoelectric fans 205, 210, 215 are generally similar in construction and design to the thermoelectric fan 200.

In FIG. 1, the thermoelectric fan 200 is secured to the barrel 15, and generally comprises an electric fan 300 and a thermoelectric device 310. The thermoelectric fan 205 generally comprises an electric fan 301 and a thermoelectric device 312. The thermoelectric fan 210 generally comprises an electric fan 302 and a thermoelectric device 314. The thermoelectric fan 215 generally comprises an electric fan 303 and a thermoelectric device 316.

As more clearly illustrated in FIG. 2, the thermoelectric device 310 may be formed of a plurality of modules, such as three modules 315. The modules 315 straddle the barrel 15 in order to absorb the optimal amount of heat emanating from the barrel 15.

The modules 315 are electrically connected to the electric fan 300, to supply it with the desired energy. As illustrated in FIG. 3, an electrically conductive wire or trace 320 connects the thermoelectric device 310 to the electric fan 300.

The electric fan 300 has an open end that is secured to the barrel 15, by means of a mechanical device, such as a clamp or a similar device, to form a cooling chamber 331 therewith. As shown in FIG. 1, the thermoelectric device 310 may be secured to the barrel 15 and is disposed next to the electric fan 300.

In the preferred embodiment of FIG. 3, the electric fan 300 includes a flat bottom 307 that matches the geometry of the modules 315 of the thermoelectric device 310. Each module 315 is made of a generally rectangularly shaped, flat, ribbon.

While FIG. 3 illustrates the electric fan 300 as a bladed fan, it should be clear that a bladeless fan or any other available and suitable electric fan might be used instead.

The thermoelectric device 310 may be comprised of any available or suitable thermoelectric modules, such as the HZ-2 thermoelectric modules from Hi-Z Technology, Inc. Quantum well and lead telluride modules or other available thermoelectric devices may be used.

The electric fan model PSD1204PBB1-A from SUNON, or any other suitable or available electric fan may be used. The electric fan 300 may, for example, be approximately 40 mm×40 mm×24 mm in dimensions, and can produce approximately 21.6 CFM of airflow.

The wire 320 may for example be nickel plated copper insulated with mica tape and a fiberglass jacket. It should be noted that other suitable conductors may alternatively be used.

When the thermoelectric device 310 is placed in contact with the hot barrel 15, it uses the recaptured heat energy to power the electric fan 300, which will accelerate the air circulation within the cooling chamber 331, to cool the barrel 15. This increases the lifespan of the barrel 15, and has the potential to reduce the weight of the barrel 15 because less material is required for a heat sink.

Figure 4:
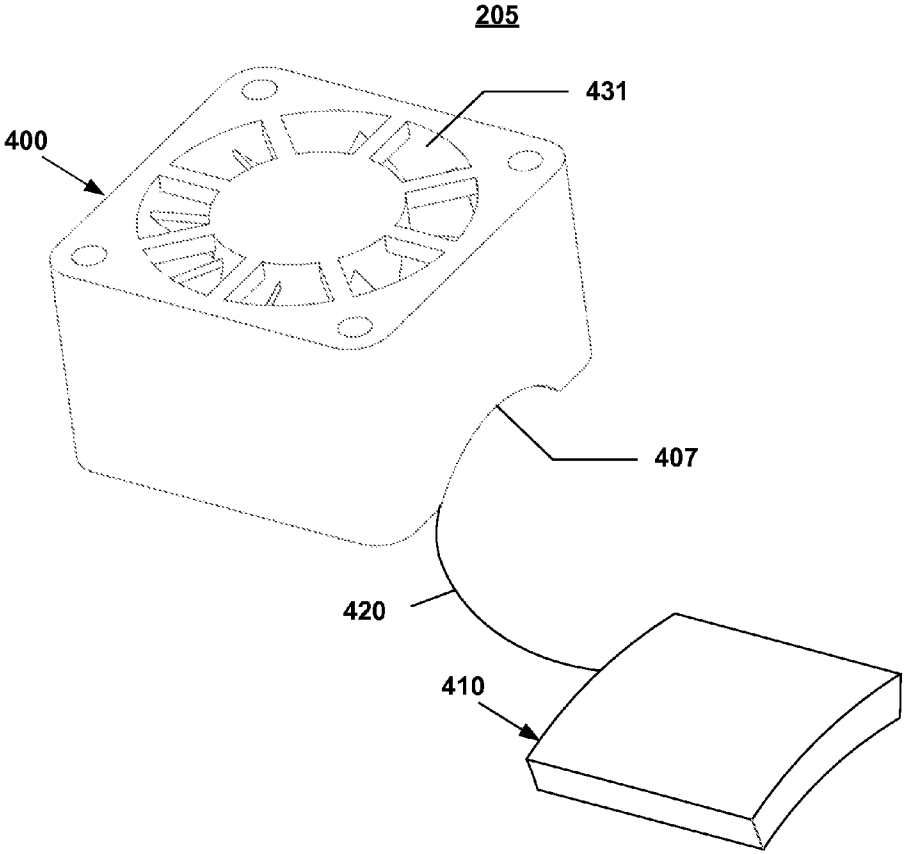
FIG. 4 is an enlarged schematic view of a thermoelectric fan according to another preferred embodiment of the present invention.

FIG. 4 illustrates another thermoelectric fan, i.e., 205 according to the present invention. The thermoelectric fan 205 is generally similar in construction and function to the thermoelectric fan 200 of FIG. 3, but allows for the bottom of the components to be curved in order to better fit around the barrel 15. The thermoelectric fan 205 is secured to the barrel 15, and generally comprises an electric fan 400 and a thermoelectric device 410. An electrically conductive wire or trace 420 connects the thermoelectric device 410 to the electric fan 400.

The electric fan 400 has an open end that is secured to the thermoelectric device 410 to form a cooling chamber 431 therewith. In turn, the thermoelectric device 410 is secured to the barrel 15, and is disposed next to the electric fan 400.

Alternatively, the electric fan 400 is secured to the barrel 15 by means of a mechanical device, such as a clamp or a similar device, with the thermoelectric device 410 sandwiched therebetween.

In a preferred embodiment, the electric fan 400 includes a curved bottom 407 that matches the shapes of both the barrel 15 and the thermoelectric device 410. The thermoelectric device 410 is made of a generally rectangularly shaped, curved, ribbon that is adhered or glued onto the curved bottom surface 407 of the electric fan 400.

Figure 5:
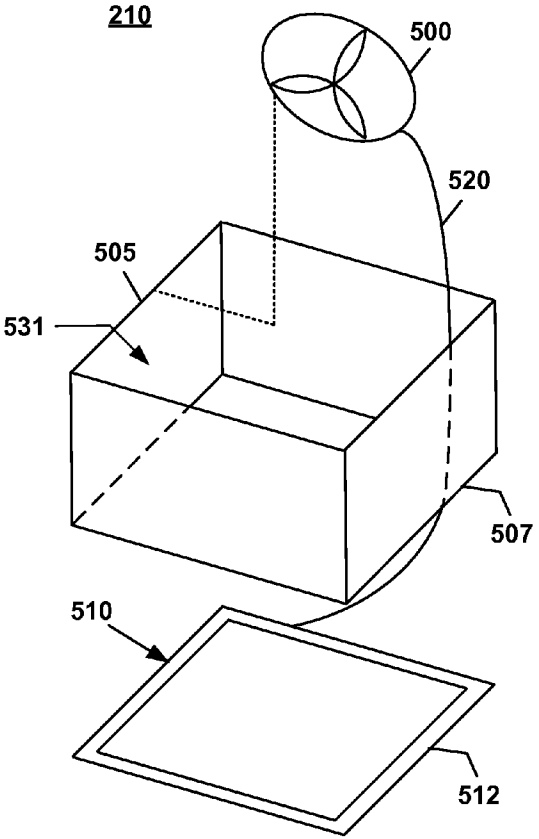
FIG. 5 is an enlarged, exploded, schematic view of a thermoelectric fan according to still another preferred embodiment of the present invention.

With reference to FIG. 5, the thermoelectric fan (i.e., 210) is generally comprised of an electric fan 500, a support structure 505, and a thermoelectric device 510. An electrically conductive wire or trace 520 connects the thermoelectric device 510 to the electric fan 500.

The support structure 505 retains the electric fan 500 a predetermined, optimal distance above the barrel 15 and forms a cooling chamber 531 therewith. The support structure 505 is open at both ends.

In the embodiment of FIG. 5, the support structure 505 includes a flat bottom 507. The thermoelectric device 510 is made of a generally rectangularly shaped, flat strip 512 that can be adhered to, or glued onto the flat bottom 507 of the support structure 505. Alternatively, the thermoelectric device 510 can be secured to the barrel 15, and disposed next to the electric fan 500.

Figure 6:
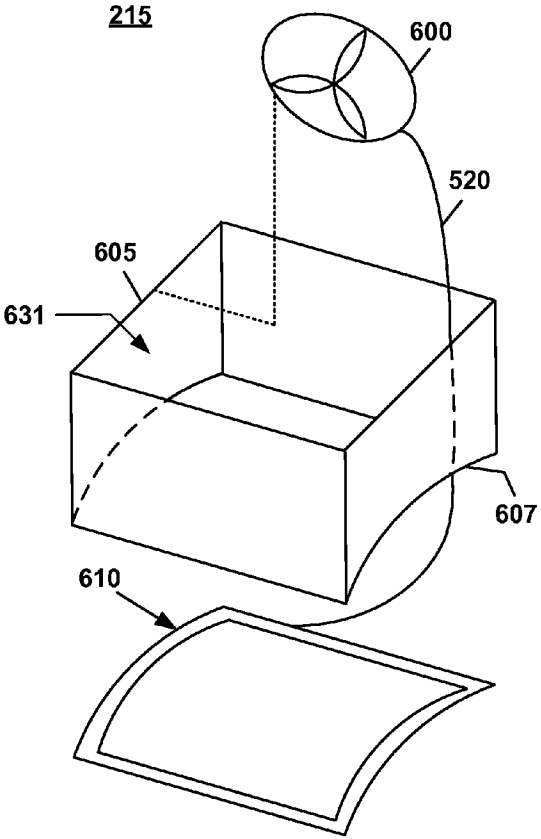
FIG. 6 is an enlarged, exploded, schematic view of a thermoelectric fan according to yet another preferred embodiment of the present invention.

With reference to FIG. 6, the thermoelectric fan (i.e., 215) is generally similar in construction and function to the thermoelectric fan 210 of FIG. 5, but is different in design. The thermoelectric fan 215 generally comprises an electric fan 600, a support structure 605, and a thermoelectric device 610. An electrically conductive wire or trace 620 connects the thermoelectric device 610 to the electric fan 600.

The support structure 605 includes a curved bottom 607 that matches the shapes of both the barrel 15 and the thermoelectric device 610. The thermoelectric device 610 is made of a generally rectangularly shaped, curved strip 612 that can be adhered to, or glued onto the curved bottom 607 of the support structure 605. Alternatively, the thermoelectric device 610 can be secured to the barrel 15, and disposed next to the electric fan 600.

In use, as the barrel 15 heats up during operation, it generates heat energy that is captured by any of the thermoelectric devices 310, 410, 510, 610. In turn, as explained earlier, the thermoelectric device, e.g., 310 automatically converts the captured heat energy into an electric current that is transmitted to the electric fan, e.g., 300, via the conductor 320. The electric fan 300 provides the desired cooling effect to the barrel 15.

In summary, the electric fan, e.g., 300 is automatically powered by the heat emanating from the barrel 15, to cool the barrel 15. It should be understood that the other thermoelectric fans 205, 210, 215 that form the cooling device 100 operate similarly to the thermoelectric fan 200 to respectively cool adjacent sections of the barrel 15. It should also be understood that the different thermoelectric fans 200, 205, 210, 215 are included here to illustrate several different potential fan configurations, and that a single configuration may be used for all thermoelectric fans in the device.

Figure 7:
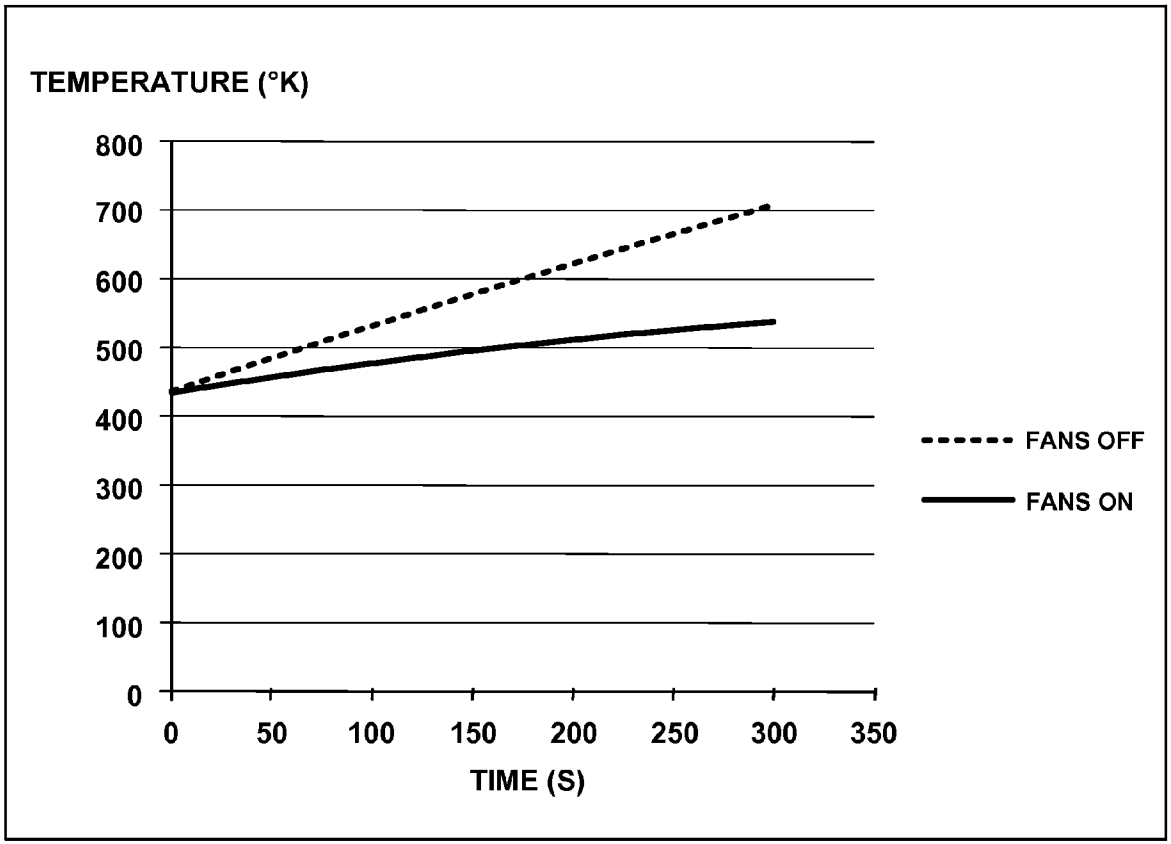
FIG. 7 is a computer simulation chart of the temperature at selected areas of the machine gun barrel, underneath the thermoelectric fans of any of FIGS. 3 through 6, with the fans turned ON and then OFF.

Experimentally, and with further reference to FIG. 7, the thermoelectric devices 310, 410, 510, 610 provide sufficient power to a reasonable configuration of electric fans 300, 400, 500, 600, respectively. A computer simulation was done of a barrel 15 firing 100 rounds per minute, with four similar thermoelectric fans 200 both ON and OFF. The fan configuration chosen was four fans over the barrel 15, which would produce a total of about 85 CFM of airflow over the barrel 15.

Each one of the thermoelectric fans 200 requires approximately 6 Watts of power at 12 Volts, which can be achieved using 3 to 4 thermoelectric devices per electric fan.

Figure 8:
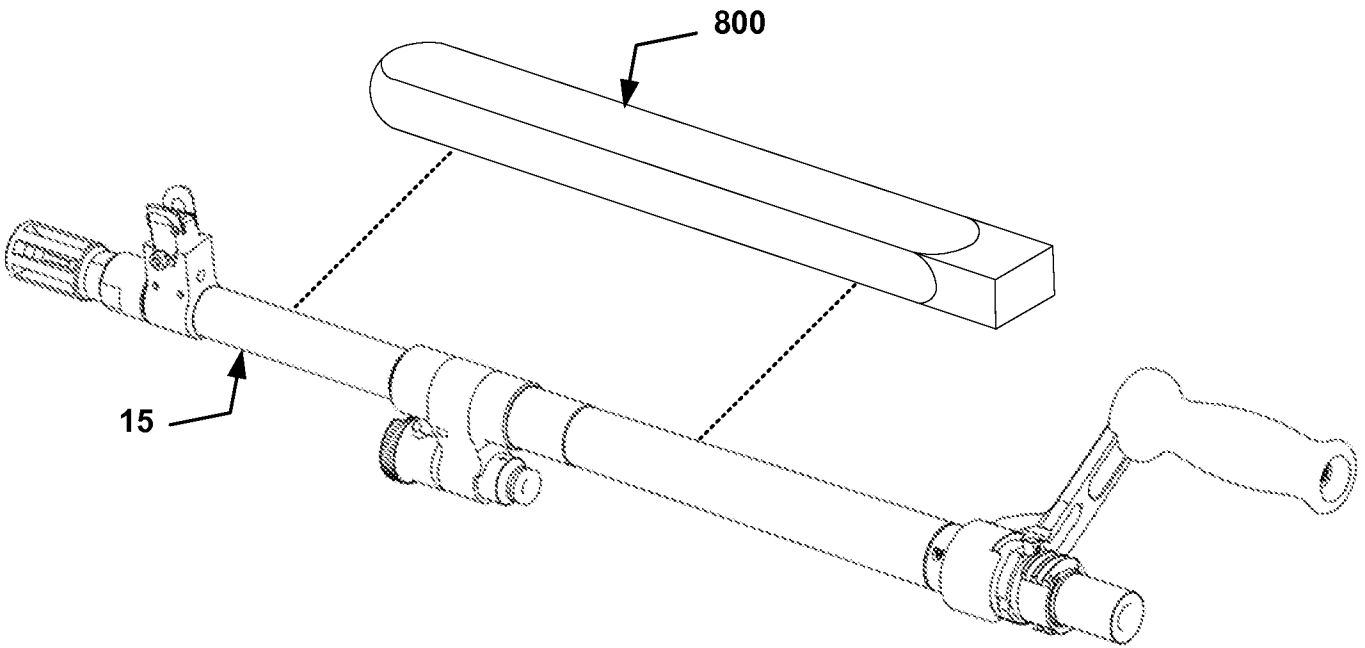
FIG. 8 is a perspective, exploded view of the machine gun barrel of FIG. 1, provided with a cooling assembly that includes bladeless thermoelectric fans, according to the present invention.

With reference to FIG. 8, it illustrates another preferred embodiment of the present invention, and shows a thermoelectric cooling assembly 800 to be mounted onto the machine gun barrel 15, as explained earlier in connection with the thermoelectric cooling devices of FIGS. 3 through 6. The cooling assembly 800 includes at least one bladeless thermoelectric fan (also referred to as Dyson fan).

It should be understood that other modifications might be made to the present design without departing from the spirit and scope of the invention.

What is claimed is:

1. A cooling device for use in conjunction with a weapon having a barrel, to cool the weapon, comprising:

a plurality of thermoelectric devices mounted on the barrel to capture heat energy generated by the barrel and to automatically convert the captured heat energy into an electric current;

a plurality of electric fans that are secured to the barrel, adjacent to the thermoelectric devices and are electrically connected to the plurality of thermoelectric devices;

wherein the plurality of electric fans define cooling chambers with the barrel; and wherein the electric current powers the plurality of electric fans to produce forced air convection within the cooling chambers, in order to cool the barrel.

2. The cooling device of claim 1, further comprising an electrically conductive wiring that electrically connects the plurality of thermoelectric devices to the plurality of electric fans.

3. The cooling device of claim 1, wherein each of the plurality of electric fans is mounted on a separate support structure.

4. The cooling device of claim 1, wherein at least some of the plurality of electric fans are mounted on a single support structure.

5. The cooling device of claim 3, wherein the support structure is open at both ends.

6. The cooling device of claim 3, wherein the support structure includes a flat bottom.

7. The cooling device of claim 3, wherein the support structure includes a curved bottom.

8. The cooling device of claim 3, wherein the support structure includes a bottom that substantially matches a surface of the barrel on which the support structure is mounted.

9. The cooling device of claim 1, wherein the weapon includes a machine gun.

10. The cooling device of claim 1, wherein the weapon includes a rifle.

* * * * *